US007575450B2

(12) United States Patent
Williams et al.

(10) Patent No.: US 7,575,450 B2
(45) Date of Patent: Aug. 18, 2009

(54) ELECTRICAL CONNECTOR ASSEMBLY

(75) Inventors: Libby Williams, Hudsonville, MI (US); Anthony Karafa, Zeeland, MI (US); Christopher Terryn, Grand Rapids, MI (US); Todd M. Kuipers, Holland, MI (US); Christopher R. Helmer, Hudsonville, MI (US)

(73) Assignee: BLD Products, Ltd, Holland, MI (US)

( * ) Notice: Subject to any disclaimer, the term of this patent is extended or adjusted under 35 U.S.C. 154(b) by 116 days.

(21) Appl. No.: 11/277,383

(22) Filed: Mar. 24, 2006

(65) Prior Publication Data

US 2007/0072461 A1 Mar. 29, 2007

Related U.S. Application Data

(60) Provisional application No. 60/594,271, filed on Mar. 24, 2005.

(51) Int. Cl.
*H01R 13/44* (2006.01)

(52) U.S. Cl. ..... 439/144

(58) Field of Classification Search ..... 439/144, 439/142, 372, 373, 606, 281, 282, 278, 271, 439/272

See application file for complete search history.

(56) References Cited

U.S. PATENT DOCUMENTS 2,409,650 A * 10/1946 Wiggins ..... 285/316
2,458,153 A * 1/1949 Festge ..... 439/272
2,840,676 A * 6/1958 King ..... 174/75 R
3,078,436 A * 2/1963 Berry ..... 439/579
3,449,706 A * 6/1969 Carissimi ..... 439/141
3,915,476 A 10/1975 Burkle
4,061,407 A 12/1977 Snow
4,072,381 A 2/1978 Burkhart et al.
4,109,989 A * 8/1978 Snyder et al. ..... 439/140
4,245,875 A * 1/1981 Shaffer et al. ..... 439/144
4,312,553 A * 1/1982 Lyckesjo ..... 439/281
4,477,136 A * 10/1984 Smith ..... 439/289
4,597,620 A * 7/1986 Lindner et al. ..... 439/277
4,702,710 A * 10/1987 Dittman et al. ..... 439/271
4,711,510 A 12/1987 Orlando, Jr.
4,770,644 A 9/1988 Feder
4,772,230 A 9/1988 Berg
4,784,610 A 11/1988 Stuart
4,969,839 A 11/1990 Nilsson
5,224,874 A 7/1993 Sell (Continued)

FOREIGN PATENT DOCUMENTS

EP 0544630 B1 11/1992

(Continued)

*Primary Examiner*—T C Patel
*Assistant Examiner*—Vladimir Imas
(74) *Attorney, Agent, or Firm*—McGarry Bair PC

(57) ABSTRACT

An electrical connector assembly, such as for use with a tractor-trailer, comprises a socket and a plug. The plug can comprise a resilient seal configured to surround mating electrical terminals on the socket and the plug. A coupler can be configured to retain the plug in the socket and compress the resilient seal against the socket. The plug can further comprise a knob having a bulbous portion sized to fit in a palm of a user's hand for ease of grasping by the user. The knob can include a drip edge.

39 Claims, 6 Drawing Sheets

U.S. PATENT DOCUMENTS

| | | | | | |
|---|---|---|---|---|---|
| 5,302,141 | A | | 4/1994 | O'Reilly et al. | |
| 5,385,476 | A | | 1/1995 | Jasper | |
| 5,443,389 | A | | 8/1995 | Hughes | |
| 5,488,352 | A | | 1/1996 | Jasper | |
| 5,637,010 | A | * | 6/1997 | Jost et al. | 439/352 |
| 5,649,835 | A | * | 7/1997 | Weed | 439/320 |
| 5,722,847 | A | * | 3/1998 | Haag | 439/320 |
| 5,735,704 | A | * | 4/1998 | Anthony | 439/271 |
| 5,739,592 | A | | 4/1998 | Rigsby et al. | |
| 5,800,188 | A | | 9/1998 | Barber et al. | |
| 5,873,744 | A | | 2/1999 | Ramos, Jr. | |
| 6,336,822 | B1 | | 1/2002 | Luzzoli | |
| 6,338,644 | B1 | | 1/2002 | Fritzinger et al. | |
| 6,422,884 | B1 | * | 7/2002 | Babasick et al. | 439/222 |
| 6,450,833 | B1 | | 9/2002 | Brown, Jr. et al. | |
| 6,475,009 | B2 | * | 11/2002 | Below et al. | 439/271 |
| 6,482,017 | B1 | * | 11/2002 | Van Doorn | 439/89 |
| 6,554,626 | B2 | | 4/2003 | Ramos, Jr. | |
| 6,592,384 | B2 | * | 7/2003 | Sawayanagi | 439/157 |
| 6,743,025 | B2 | | 6/2004 | Howard | |
| 7,097,469 | B2 | * | 8/2006 | Jacobs | 439/83 |
| 2004/0077203 | A1 | * | 4/2004 | Dewitt et al. | 439/271 |

FOREIGN PATENT DOCUMENTS

| | | | |
|---|---|---|---|
| EP | 0585917 | A2 | 3/1994 |

* cited by examiner

ELECTRICAL CONNECTOR ASSEMBLY

CROSS-REFERENCE TO RELATED APPLICATION

This application claims the benefit of U.S. Patent Application No. 60/594,271, filed Mar. 24, 2005, the complete disclosure of which is incorporated by reference.

BACKGROUND OF THE INVENTION

1. Field of the Invention

The invention relates generally to an electrical connector assembly for a tractor-trailer and particularly to a tractor-trailer electrical connector assembly that withstands potentially degrading environmental conditions.

2. Description of the Related Art

Electrical connector assemblies known in the art as a seven-way assembly are well known devices that electrically communicate a tractor with a trailer or electrically communicate adjacent trailers for operation of a variety of electrical systems, including brake lights, running lights, turn signal lights, and anti-lock braking systems. Because the tractor-trailer is a modular assembly, wherein the trailer can be viewed as an interchangeable component, all tractor-trailer electrical connector assemblies must have standardized interconnections that adhere to the Society of Automotive Engineers (SAE) standard J560. While all electrical connector assemblies follow SAE standards, particular electrical connector assemblies can differ from one another in features outside the J560 specification.

Typically, the electrical connector assembly comprises a cable of sheathed electrical wires that terminates on both ends at a plug that is removably received in a socket mounted on the tractor or trailer. The cable can join a tractor with an adjacent trailer or two adjacent trailers. For example, when the cable joins a tractor with an adjacent trailer, each of the tractor and the trailer has a socket, which is coupled to electrical wires in the respective tractor or trailer, and the plugs on the ends of the cable mate with the sockets to electrically couple the tractor to the trailer. Similarly, when the cable joins adjacent trailers, each of the trailers has a socket that removably receives one of the plugs. The socket usually has a plurality of male pins that mate with a plurality of female terminals on the plug. The male pins and the female terminals are typically soldered or welded to the metallic ends of the wires in the sheathed cable, and the wires in the tractor or trailer are likewise connected to the back side of the socket with metal joining processes.

The metallic connections in plugs and sockets, even when the plug and the socket are connected to one another, are exposed to the environment and therefore susceptible to corrosion and other degrading processes. Corrosion of metals occurs in moist environments and can be accelerated in the presence of certain chemicals. Thus, environmental conditions are especially harsh during the winter in areas where salt and other chloride containing chemicals, such as calcium chloride, are applied to the roads. Further, a practice called "pre-wetting" where the chemicals are wet prior to application to the road to increase effectiveness and decrease the tendency for the chemicals to be blown off the road has become common and can exacerbate corrosion problems. The wet chemical mixture can easily spray, such as by the tires of the tractor-trailer, directly onto the electrical connector assembly. Even if the chemicals are left to dry, the solid crystals are very hydroscopic and, therefore, attract moisture to form a wet mixture, which is more corrosive than dry chloride containing chemicals. Thus, it is desirable for a tractor-trailer electrical connector assembly to withstand potentially degrading environmental conditions.

SUMMARY OF THE INVENTION

A plug according to one embodiment of the invention for an electrical connector assembly comprising a socket having a receptacle defining an interior that terminates at a wall having a proximal face, at least one electrical terminal accessible through the receptacle, and a catch configured to mate with the plug to retain the plug in the socket comprises a body sized for receipt within the interior of the receptacle and having a distal end; at least one electrical terminal carried by the body and configured to mate with the at least one electrical terminal on the socket; a catch receiver formed on the body and configured to mate with the catch on the socket to retain the plug in the socket; and a resilient seal located at the distal end of the body and configured to surround the mating electrical terminals and compress against the proximal face of the receptacle wall when the catch on the socket mates with the catch receiver on the plug body.

The catch receiver can comprise a key formed on the body and configured to be received within a keyway formed in the socket receptacle. The key can comprise a proximal end configured for abutting contact with the catch to retain the plug in the socket and compress the resilient seal against the proximal face of the receptacle wall. A distance between the catch and the proximal face of the receptacle wall can be less than a distance between the key proximal end and a distal end of the resilient seal when the resilient seal is uncompressed.

The resilient seal can extend distally beyond the distal end of the body. The resilient seal can comprise a peripheral lip.

The socket and the plug can each comprise seven of the electrical terminals.

The resilient seal can be made from a polymeric material. The polymeric material can comprise polyvinyl chloride.

The body can be formed by a core and an outer cover of differing rigidity. The resilient seal can be integrally formed with the core. The resilient seal can be configured to be compressed between the cover and the proximal face of the receptacle wall when the catch mates with the catch receiver.

An electrical connector assembly according to another embodiment of the invention comprises a socket comprising: a receptacle defining an interior that terminates at a wall having a proximal face; and at least one electrical terminal accessible through the receptacle. The electrical connector assembly further comprises a plug comprising: a body sized for receipt within the interior of the receptacle and having a distal end; at least one electrical terminal carried by the body and configured to mate with the at least one electrical terminal on the socket; and a resilient seal located at the distal end of the body and configured to surround the mating electrical terminals. The electrical connector assembly further comprises a coupler configured to retain the plug in the socket such that the resilient seal compresses against the proximal face of the receptacle wall.

The coupler can comprise a catch on one of the socket and the plug and a catch receiver on the other of the socket and the plug, wherein the catch and the catch receiver can be configured to mate with one another to retain the plug in the socket. The catch receiver can comprise a key formed on the body and configured to be received within a keyway formed in the socket receptacle. The socket can further comprise a closure movable to selectively close the interior of the receptacle, and the catch can comprise a finger depending from the closure. The key can comprise a proximal end configured for abutting contact with the finger to retain the plug in the socket and compress the resilient seal against the proximal face of the receptacle wall. A distance between the finger and the proximal face of the receptacle wall can be less than a distance between the key proximal end and a distal end of the resilient seal when the resilient seal is uncompressed.

The resilient seal can extend distally beyond the distal end of the body. The resilient seal can comprise a peripheral lip.

The socket and the plug can each comprise seven of the electrical terminals.

The resilient seal can be made from a polymeric material. The polymeric material can comprise polyvinyl chloride.

The body can be formed by a core and an outer cover of differing rigidity. The resilient seal can be integrally formed with the core. The resilient seal can be configured to be compressed between the cover and the proximal face of the receptacle wall when the catch mates with the catch receiver.

A plug according to another embodiment of the invention for an electrical connector assembly comprises a body carrying at least one electrical terminal; and a knob comprising a bulbous portion sized to fit in a palm of a user's hand for ease of grasping by the user.

The knob can further comprise a distal wall configured to accommodate at least two fingers of the user with the body between the at least two fingers. The plug can further comprise a neck connecting the body to the knob. The neck can join the knob at the distal wall such that when the user places the at least two fingers on the distal wall, the user can place each of the at least two fingers on opposite sides of the neck.

The knob can further comprise a drip edge configured to prevent fluid from flowing from the knob to the body. The drip edge can comprise a groove formed in the knob. The groove can extend circumferentially around the knob. The groove can have an arcuate profile.

DESCRIPTION OF EMBODIMENTS OF THE INVENTION

Figure 1:
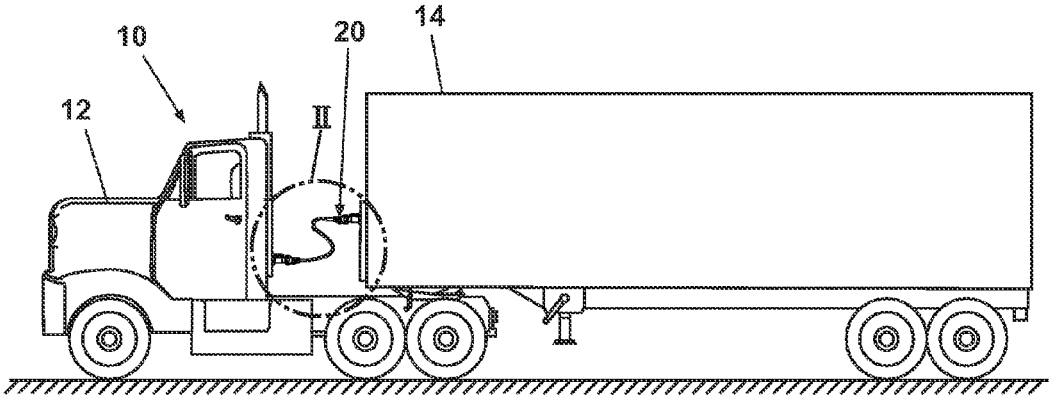
FIG. 1 is a side view of a tractor-trailer equipped with an electrical connector assembly according to one embodiment of the invention.
Figure 2:
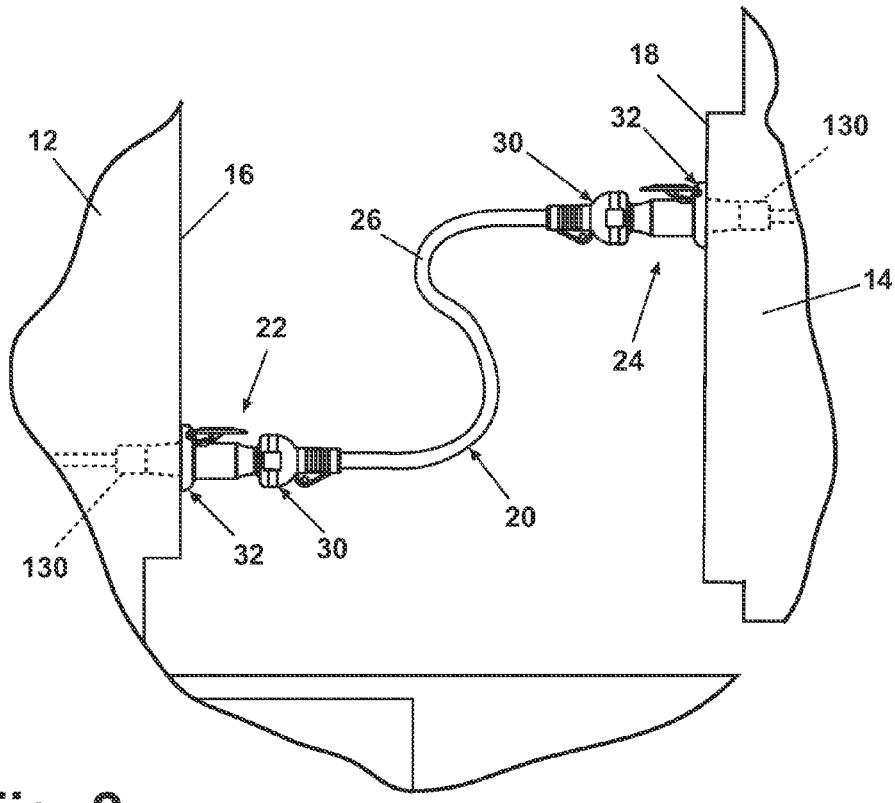
FIG. 2 is an enlarged view of the region labeled II of FIG. 1 showing the electrical connector assembly electrically coupling a tractor with a trailer.

Referring now to the figures, FIG. 1 illustrates an exemplary, conventional tractor-trailer 10 comprising a tractor 12 electrically coupled to a trailer 14 by an electrical connector assembly 20 according to one embodiment of the invention. As shown in FIG. 2, which is an enlarged view of the area labeled II in FIG. 1, the tractor 12 includes a rear wall 16 that supports a tractor portion 22 of the electrical connector assembly 20, and, similarly, the trailer 14 has a front wall 18 that supports a trailer portion 24 of the electrical connector assembly 20. The tractor portion 22 and the trailer portion 24 are connected by a cable 26 of sheathed electrical wires to electrically couple the tractor 12 to the trailer 14. The cable 26 terminates at a pair of plugs 30, which are removably received by a corresponding socket 32 mounted to the corresponding rear wall 16 of the tractor 12 or the front wall 18 of the trailer 14. While the electrical connector assembly 20 is shown and described herein as electrically coupling the tractor 12 to the trailer 14, it is within the scope of the invention for the electrical connector assembly 20 to couple adjacent trailers, in which case, the electrical connector assembly 20 would comprise two trailer portions 24, one on one trailer and another on the adjacent trailer, rather than a tractor portion 22 and a trailer portion 24. The tractor portion 22 and the trailer portion 24 are identical; therefore, the remainder of the description focuses on the trailer portion 24 with it understood that the description also applies to the tractor portion 22.

Figure 3:
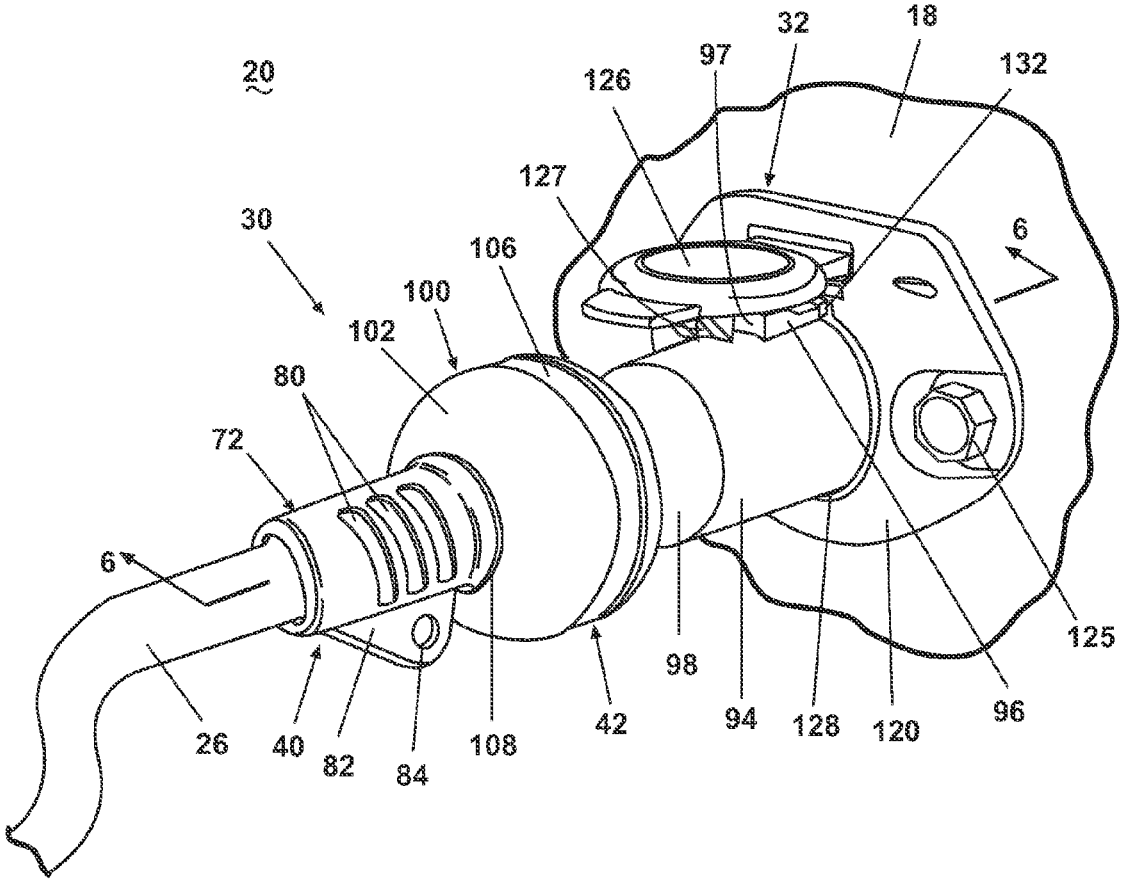
FIG. 3 is a perspective view of a plug and a socket of the electrical connector assembly of FIGS. 1 and 2 in a coupled condition.
Figure 4:
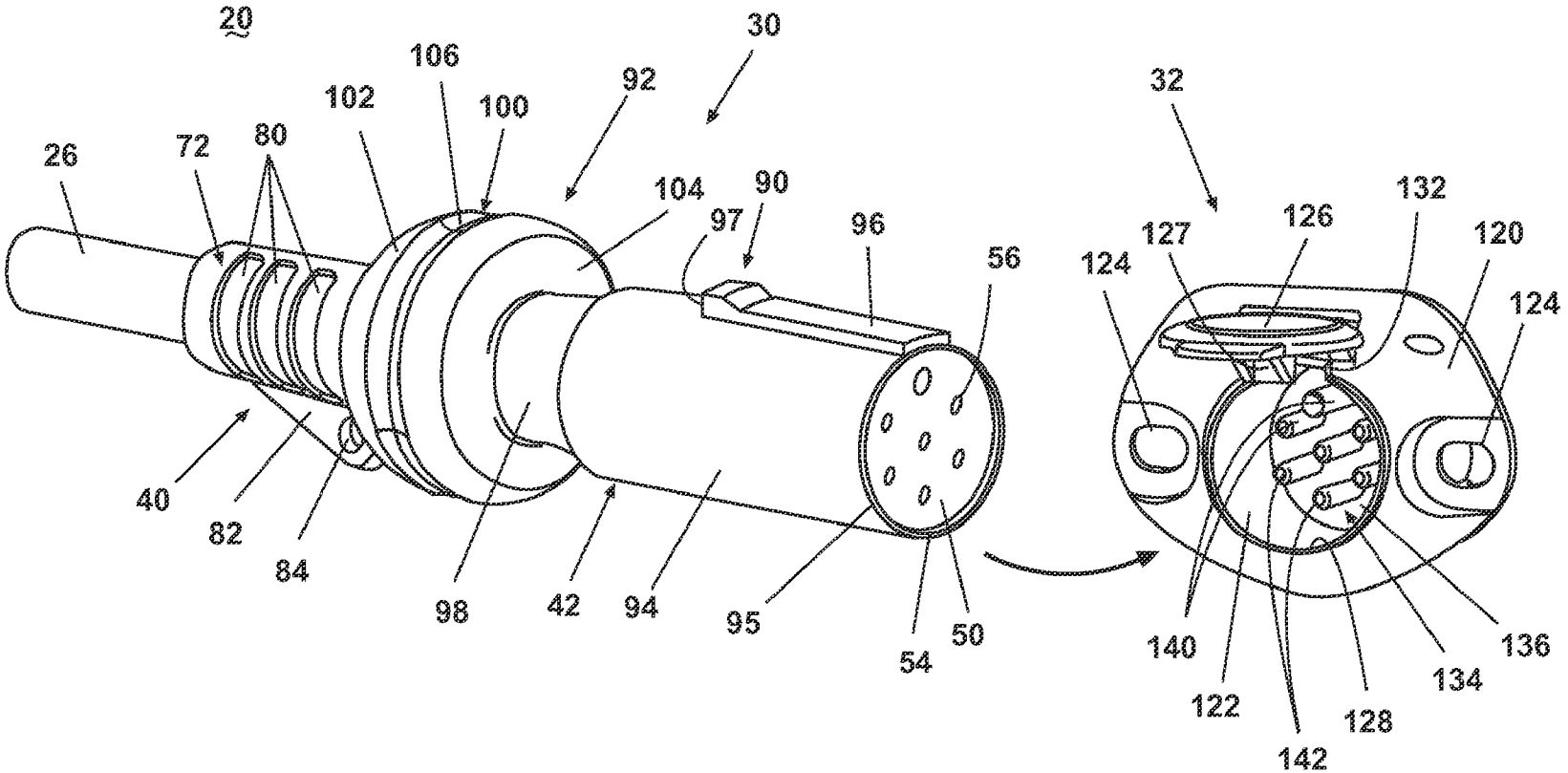
FIG. 4 is a perspective view of the plug and the socket of FIG. 3 in an uncoupled condition.
Figure 5:
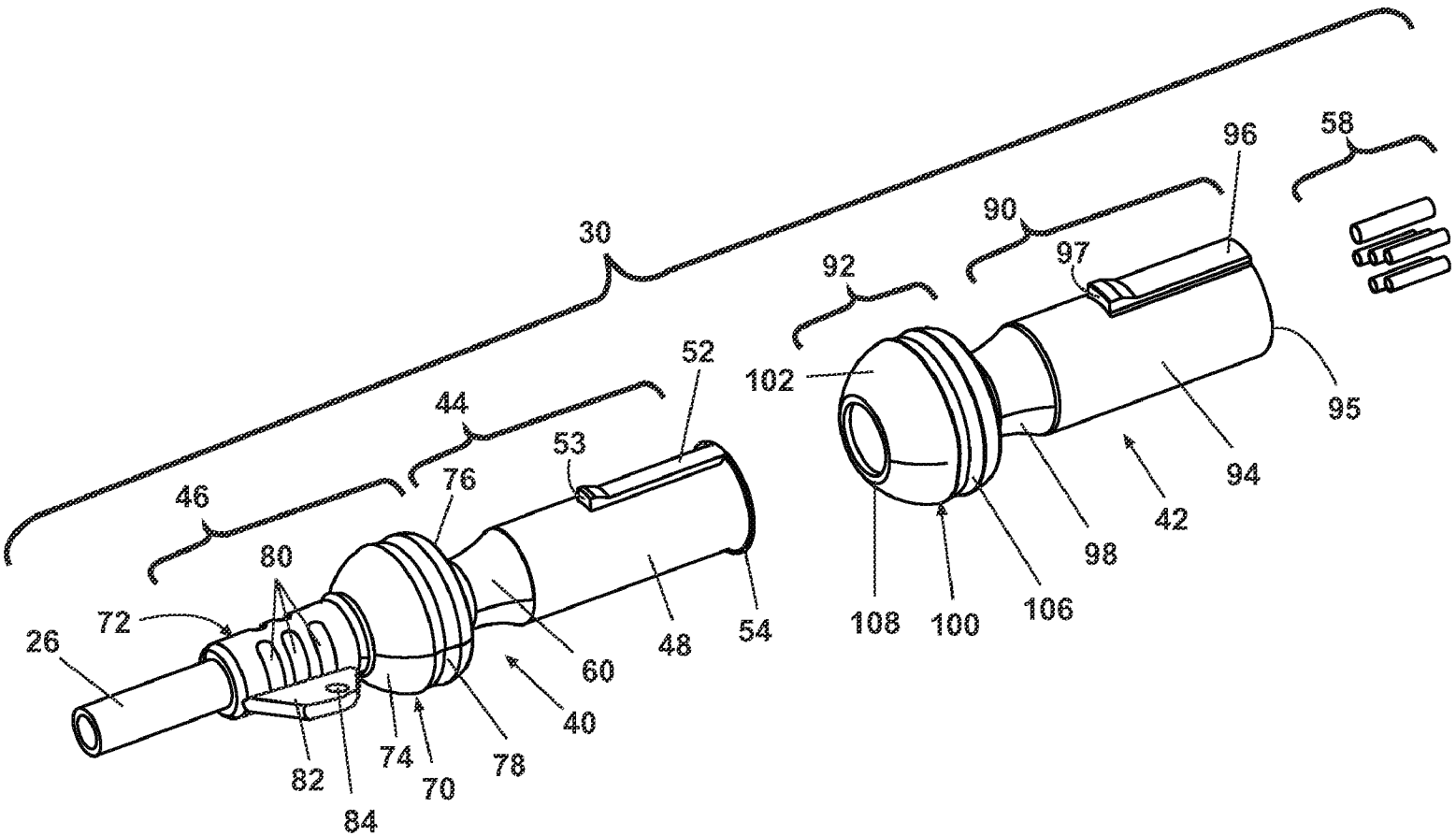
FIG. 5 is an exploded view of the plug of FIG. 3.

Referring now to FIG. 3, where the plug 30 and the socket 32 are shown in a coupled condition, FIG. 4, where the plug 30 and the socket 32 are shown in an uncoupled condition, and FIG. 5, where the plug 30 is shown in an exploded view, the plug 30 comprises an elongated core 40 molded over an end of the cable 26 and a cover 42 overmolded onto the core 40. According to the illustrated embodiment of the invention, the core 40 is made from a polymeric material. The polymeric material can be a resilient polymeric material, such as a resilient polyvinyl chloride. For example, the polyvinyl chloride can have a durometer of about 75. According to the illustrated embodiment of the invention, the cover 42 is made from a polymeric material. The polymeric material can be a material less resilient (i.e., more rigid) than that of the core 40, such as nylon. An exemplary nylon material is a nylon 6 material, such as N605HS, which is commercially available from Michael Day Enterprises.

With continued reference to FIGS. 3-5, the core 40 comprises a distal portion 44 integrally formed with a proximal portion 46, where distal and proximal refer to relative positions farther from and closer to a person holding the plug 30 at the cable 26. The distal portion 44 includes an elongated, generally cylindrical body 48 having a terminal face 50 at a distal end thereof and a longitudinal key 52 formed on an outer surface and extending proximally from a peripheral sealing lip 54 that surrounds the terminal face 50 to a proximal end 53. According to the illustrated embodiment, the sealing lip 54 extends forwardly (i.e., distally) of the terminal face 50 in a longitudinal direction as well as outwardly from the terminal face 50 in a radial direction. The body 48 further includes a plurality of elongated channels 56 formed therein that open at the terminal face 50 and are sized to receive a plurality of metallic female terminals 58. The sealing lip 54 surrounds the openings for the elongated channels 56 at the terminal face 50. At an opposite end, the body 48 tapers toward the proximal portion 46 at a neck 60.

Figure 6:
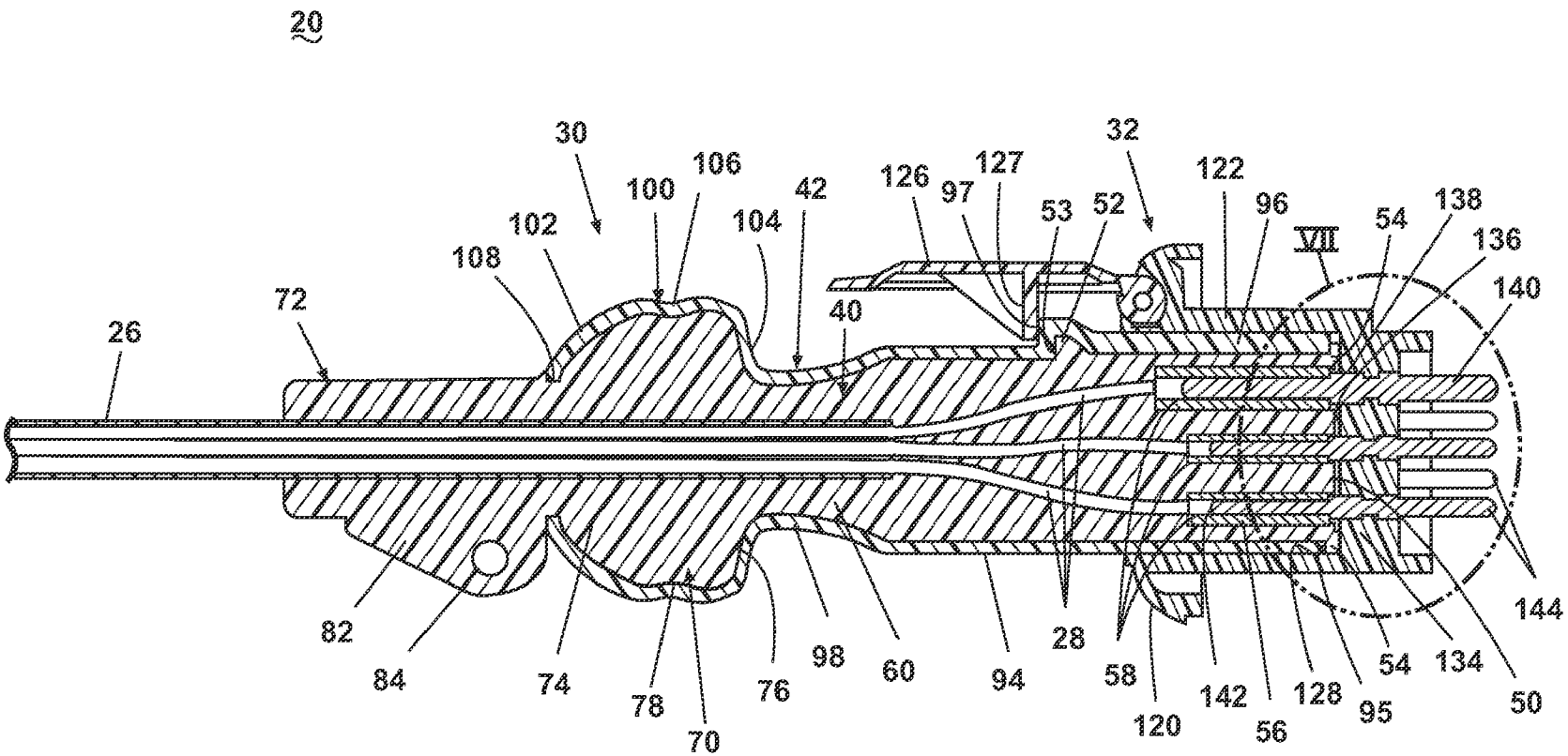
FIG. 6 is a sectional view taken along line 5-5 of FIG. 3 with the plug and socket in the coupled condition.

The proximal portion 46 of the plug core 40 comprises a knob 70 at a distal end thereof and an integral cable cover 72 at a proximal end thereof. The knob 70 is formed by a generally convex bulbous body 74 that terminates at a slightly curved, annular distal wall 76, which merges with the neck 60 of the distal portion 44. The knob 70 further includes a drip edge in the form of a generally concave circumferential groove 78 that extends around the bulbous body 74 near the distal wall 76. The groove 78 has an arcuate profile when viewed in section, as shown in FIG. 6. While the drip edge is shown and described as the concave groove 78, it is within the scope of the invention for the drip edge to assume other forms, such as a rectangular or other geometrically shaped groove or a circumferential projection that extends radially outward from the bulbous body 74. The cable cover 72 extends proximally of the bulbous knob 70 to cover and support the cable 26 and includes a plurality of ribs 80 formed therein for increased strength and flexibility. A radial tab 82 extends radially from the cable cover 72 and has a hole 84 formed therein for hanging and storing the plug 30 in a convenient location when not in use.

With continued reference to FIGS. 3-5, the cover 42 that is molded over the core 40 has a shape substantially similar to the core 40 and comprises a distal portion 90 and a proximal portion 92. The distal portion 90 is formed by a generally hollow cylindrical body 94, a longitudinal key 96 with a proximal end 97, and a tapered neck 98 that correspond to and overlie the body 48, the key 52, and the neck 60, respectively, of the core distal portion 44. The body 94 has a distal end 95 and is sized such that its distal end 95 abuts a proximal side of the radially and forwardly extending sealing lip 54, as best seen in FIGS. 6 and 7.

Referring again to FIGS. 3-5, the proximal portion 92 comprises a knob 100 having a generally convex bulbous body 102 that terminates at a slightly curved, annular distal wall 104, which merges with the neck 98 of the distal portion 90. The knob 100 provides an easily graspable region of the cover 42 to facilitate handling of the plug 30 by the user. For example, the user can grasp the knob 100 in the palm of a hand and position a forefinger and a middle finger on the distal wall 104 with the neck 60 therebetween. As with the core knob 70, the cover knob 100 further includes a drip edge in the form of a generally concave circumferential groove 106 that extends around the bulbous body 102 near the distal wall 104. The body 102, the distal wall 104, and the groove 106 of the cover 42 correspond to and overlie the body 74, the distal wall 76, and the groove 78, respectively, of the core 40. Additionally, the drip edge can assume forms, including projections, other than the concave groove 106 shown and described herein. The proximal portion 92 terminates in a circular aperture 108 at a proximal portion of the knob 100 to accommodate the cable cover 72.

Figure 7:
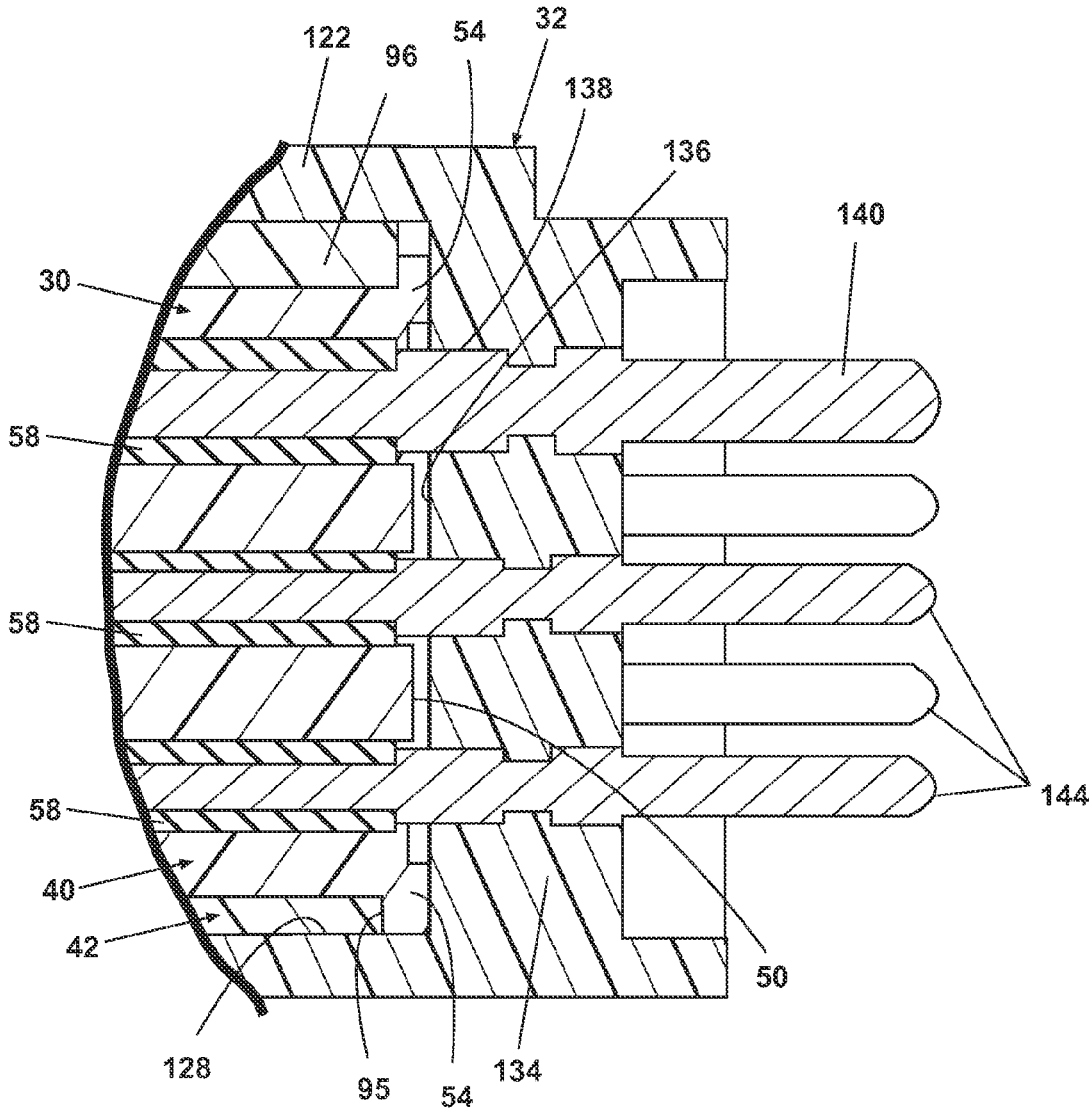
FIG. 7 is an enlarged view of the region labeled VII in FIG. 6.

To manufacture the plug 30, wires 28 extending from the cable 26 are attached to the female terminals 58, such as by crimping the wires 28 to the female terminals 58 or by soldering or welding the wires 28 to the female terminals 58, to form an electrical connection therebetween, as shown in FIGS. 6 and 7. Next, the cable 26 with the wires 28 and the female terminals 58 are inserted into a mold, and polymeric material is injected into the mold to form the core 40 over the cable 26, the wires 28, and the female terminals 58. The female terminals 58 are positioned in the mold such that their distal ends are generally flush with or positioned slightly proximally of the terminal face 50 of the core 40. Next, the core 40, the cable 26, the wires 28, and the female terminals 58 are removed and placed in another mold to overmold the cover 42 onto the core 40.

Referring again to FIGS. 3, 4, and 6, the socket 32 that removably receives the plug 30 comprises a flange 120 with a distally extending, generally cylindrical receptacle 122. When the socket 32 is mounted to the front wall 18 of the trailer 14, the flange 120 abuts the exterior surface of the front wall 18, and the receptacle 122 projects through the front wall 18 and into the trailer 14. The flange 120 includes a pair of mounting holes 124 to facilitate mounting of the socket 32 to the front wall 18 with fasteners 125. The flange 120 supports a hinged closure 126 that is biased to a closed position over an insert opening 128 in the flange 120 by a biasing member, such as a torsion spring, as is well known in the tractor-trailer electrical connector art. The closure 126 comprises a finger 127 on a side that faces the plug 30 when the plug 30 is coupled with the socket 32. The insert opening 128 and the receptacle 122 include a keyway 132 sized to receive the key 96 on the cover 42 of the plug 30 to properly orient the plug 30 relative to the socket 32. The insert opening 128 leads into an interior of the receptacle 122, which has formed therein a support wall 134 with a proximal face 136. The support wall 134 has a plurality of apertures 138 extending therethrough for receiving a plurality of male pins 140. According to one embodiment of the invention, the male pins 140 are double ended in that each includes a proximal end 142 that extends toward the insert opening 128 for mating with the female terminals 58 of the plug 30 and a distal end 144 that extends away from the flange 120 for mating with female terminals of a corresponding plug 130 (FIG. 2) disposed inside the trailer 14. In this configuration, the socket 32 can be removed from the trailer 14 by simply pulling it from the corresponding plug 130 in the trailer 14. Optionally, the socket 32 can include a collar (not shown) that surrounds the receptacle 122 and engages the corresponding plug 130 in the trailer 14 to facilitate mounting the corresponding plug 130 in the trailer 14 to the distal side of the socket 32. Alternatively, the male pins 140 can comprise the proximal ends 142 for mating with the plug 30 and be adapted for direct connection at the opposite side to electrical wires in the trailer 14 for a more permanent mounting to the trailer 14, as is well known in the tractor-trailer electrical connector assembly art. The socket 32 can be made of any suitable material, such as a polymeric material. An exemplary polymeric material is a polyvinyl chloride material, such as a polyvinyl chloride having a durometer of about 75.

In operation, the plugs 30 of the electrical connector assembly 20 are inserted into their respective sockets 32 on the tractor 12 and the trailer 14 to establish electrical communication between the tractor 12 and the trailer 14. As seen in FIGS. 3 and 6, the key 96 on the cover 42 of the plug 30 aligns with the keyway 132 in the socket 32 to ensure that the proximal ends 142 of the male pins 140 properly align with the female terminals 58. When the plug 30 is fully inserted into the socket 32, the finger 127 on the closure 126 abuts the proximal end 97 of the key 96 to hold the closure 126 in an opened position and to help retain the plug 30 in the socket 32 by applying a distal force to the plug 30. Thus, the finger 127 and the key 96 together form a coupler that helps to retain the plug 30 in the socket 32. The coupler comprises a catch in the form of the finger 127 and a catch receiver in the form of the key 96.

When the plug 30 is fully inserted into the socket 32, the sealing lip 54 extends distally from the terminal face 50 of the plug core 40 to abut the proximal face 136 of the support wall 134 in the receptacle 122, as shown in FIGS. 6 and 7, and thereby form a fluid tight seal between the plug 30 and the receptacle 32. Because the sealing lip 54 is made of a generally resilient material, the sealing lip 54 conforms to the proximal face 136 to form an effective seal therewith. Additionally, the distal end 95 of the less resilient cover body 94 located directly proximally of the sealing lip 54 applies an axial force to the sealing lip 54 to help the sealing lip 54 compress against and seal with the proximal face 136, as seen in FIGS. 6 and 7. As a result of this configuration, the sealing lip 54 compresses between the cover 42 and the support wall 134. Compression of the sealing lip 54 against the proximal face 136 is enhanced by the distal force applied to the plug 30 by the finger 127 on the closure 126. To help achieve this compression, a distance between the finger 127 and the proximal face 136 of the support wall 134 is less than a distance between the proximal end 97 of the key 96 and a distal end of the sealing lip 54 when the sealing lip 54 is uncompressed. As a result of the difference in these distances, the sealing lip 54 compresses when the finger 127 is placed into abutting contact with the proximal end 97 of the key 96. The seal formed by the sealing lip 54 and the support wall 134 surrounds the male pins 140 and the female terminals 58 to prevent moisture and corrosive chemicals, such as those contained in road salt and salt sprays, from accessing these metallic components.

Additionally, the groove 106 functions as a drip guard that collects liquid that flows onto the bulbous body 102 of the knob 100 from the cable cover 72 and the cable 26. When the liquid in the groove 106 reaches a critical volume, the liquid drips or otherwise flows from the groove 106 onto a surface therebelow. Thus, the groove 106 prevents liquid from flowing onto the distal portion 90 and towards the interface between the male pins 140 and female terminals 58. Furthermore, the plug 30 even further protects the female terminals 58 and the wires 28 from corrosion because the core 40 is molded directly onto the cable 26, the wires 28, and the female terminals 58 to effectively form a seal around these components.

While the embodiment of the invention presented above has been shown and described as comprising a plug with female terminals and a socket with male pins, it is within the scope of the invention for the electrical terminals to be reversed so that the plug has male pins and the socket has female terminals. Similarly, the socket can have distal female terminals for mating with corresponding male pins in a corresponding plug that mates with the distal side of the socket. Any type of electrical terminals can be used, and the electrical terminals are not limited to those shown in the figures. Additionally, the materials for the plug core and the plug cover are not limited to materials having differing resiliency; rather, the materials can have the same resiliency and can even be the same material. The plug can be formed by insert molding the cable and the electrical terminals into a plug body, as described above, or the plug can be manufactured by other processes, such as by inserting the cable and electrical terminals into a pre-formed plug. Further, the plug need not comprise a separate core and cover; rather, the plug can comprise a unitary plug body. Features of the plug, such as the sealing lip and the drip guard, can be incorporated into any plug, including those without a separate core and cover. Additionally, features, such as the sealing lip and the drip guard, can be incorporated into a plug individually and are not required to be employed in the same plug.

The seal can have configurations other than the peripheral lip 54 described above and shown in the figures. For example, the seal can comprise the entire terminal face 50 when the distal ends of the female terminals 58 are not flush with the terminal face 50. In other words, when the female terminals 58 are positioned such that their distal ends are located proximally of the terminal face 50, the portion of the body 48 between the female terminals 58 and the terminal face 50 can compress against the socket support wall 134 to form the seal. As another example, the seal can be formed by a plurality of distally ending resilient lips that individually surround each of the openings for the channels 56 on the terminal face 50. Alternatively, the seal can be formed on the socket 32, such as on the support wall 143, rather than on the plug 30. Furthermore, the seal need not be integrally formed with the body 48; rather, the seal can be a separate component coupled to the body 48 in any suitable manner.

Furthermore, the electrical connector assembly can comprise any suitable coupler for retaining the plug 30 in the socket 32. The coupler can comprise the catch on the plug 30 and the catch receiver on the socket 32 or vice-versa. The catch and the catch receiver can have any suitable form and are not limited to those described above and shown in the figures. The catch and the catch receiver shown above are those that conform to the J560 SAE standard, but other catches and catch receivers are contemplated. For example, the catch and catch receiver can be in the form of external threads on the plug 30 and internal threads on the socket 32, whereby the plug 30 is screwed into the socket 32.

While the invention has been specifically described in connection with certain specific embodiments thereof, it is to be understood that this is by way of illustration and not of limitation. For example, the female terminals in the plug can be replaced with male pins, and the male pins in the socket can be replaced with female terminals. The scope of the appended claims should be construed as broadly as the prior art will permit.

What is claimed is:

1. A plug for an electrical connector assembly, the electrical connector assembly comprising a socket having a receptacle defining an interior that terminates at a wall having a proximal face, at least one socket electrical terminal accessible through the receptacle, and a catch configured to mate with the plug to retain the plug in the socket, the plug comprising:

a body sized for receipt within the interior of the receptacle and having a distal end;

at least one plug electrical terminal carried by the body and configured for coupling with the at least one socket electrical terminal;

a catch receiver formed on the body and configured to couple with the catch on the socket to retain the plug in the socket; and the body terminating in a resilient portion including a resilient annular seal configured to encircle the coupled electrical terminals, and extend distally beyond the distal end of the body such that the resilient annular seal compresses against the proximal face of the receptacle wall when the catch on the socket couples with the catch receiver on the plug body.

2. The plug according to claim 1, wherein the catch receiver comprises a key formed on the body and configured to be received within a keyway formed in the socket receptacle.

3. The plug according to claim 2, wherein the key comprises a proximal end configured for abutting contact with the catch to retain the plug in the socket and compress the resilient seal against the proximal face of the receptacle wall.

4. The plug according to claim 3, wherein a distance between the catch and the proximal face of the receptacle wall is less than a distance between the key proximal end and a distal end of the resilient seal when the resilient seal is uncompressed.

5. The plug according to claim 1, wherein the resilient seal comprises a peripheral lip.

6. The plug according to claim 1, wherein the socket and the plug each comprise seven of the electrical terminals.

7. The plug according to claim 1, wherein the resilient seal is made from a polymeric material.

8. The plug according to claim 7, wherein the polymeric material comprises polyvinyl chloride.

9. The plug according to claim 1, wherein the body is overlain by an outer cover having a differing rigidity.

10. The plug according to claim 9, wherein the resilient seal is uninterruptedly formed with the body.

11. The plug according to claim 10, wherein the resilient seal is configured to be compressed between the outer cover and the proximal face of the receptacle wall when the catch mates with the catch receiver.

12. An electrical connector assembly comprising:
a socket comprising:
a receptacle defining an interior that terminates at a wall having a proximal face; and
at least one socket electrical terminal accessible through the receptacle;
a plug comprising:
a body sized for receipt within the interior of the receptacle and having a distal end;
at least one plug electrical terminal carried by the body and configured for coupling with the at least one socket electrical terminal; and
the body terminating in a resilient portion including a resilient annular seal extending from the distal end of the body and configured to encircle the coupled electrical terminals; and
a coupler configured to retain the plug in the socket and effect compression of the resilient seal against the proximal face of the receptacle wall.

13. The electrical connector assembly according to claim 12, wherein the coupler comprises a catch on one of the socket and the plug and a catch receiver on the other of the socket and the plug, wherein the catch and the catch receiver are configured to mate with one another to retain the plug in the socket.

14. The electrical connector assembly according to claim 13, wherein the catch receiver comprises a key formed on the body and configured to be received within a keyway formed in the socket receptacle.

15. The electrical connector assembly according to claim 14, wherein the socket further comprises a closure movable to selectively close the interior of the receptacle, and the catch comprises a finger depending from the closure.

16. The electrical connector assembly according to claim 15, wherein the key comprises a proximal end configured for abutting contact with the finger to retain the plug in the socket and compress the resilient seal against the proximal face of the receptacle wall.

17. The plug according to claim 16, wherein a distance between the finger and the proximal face of the receptacle wall is less than a distance between the key proximal end and a distal end of the resilient seal when the resilient seal is uncompressed.

18. The plug according to claim 12, wherein the resilient seal extends distally beyond the distal end of the body.

19. The plug according to claim 18, wherein the resilient seal comprises a peripheral lip.

20. The plug according to claim 12, wherein the socket and the plug each comprise seven of the electrical terminals.

21. The plug according to claim 12, wherein the resilient seal is made from a polymeric material.

22. The plug according to claim 21, wherein the polymeric material comprises polyvinyl chloride.

23. The plug according to claim 12, wherein the body is overlain by an outer cover having a differing rigidity.

24. The plug according to claim 23, wherein the resilient seal is uninterruptedly formed with the body.

25. The plug according to claim 24, wherein the resilient seal is configured to be compressed between the outer cover and the proximal face of the receptacle wall when the catch mates with the catch receiver.

26. An electrical connector assembly comprising:
a socket comprising:
a receptacle defining a cavity that terminates at an immovable wall having a proximal face; and
at least one socket electrical terminal extending through the immovable wall into the receptacle and accessible therethrough;
a plug comprising:
a body configured for selective retention within the cavity of the receptacle, and having a distal end terminating in an immovable face;
at least one plug electrical terminal carried by the body and accessible through the immovable face, and configured for coupling with the at least one socket electrical terminal; and
a compressible ring-like peripheral seal located at the distal end of the body, and configured to encircle the immovable face;
wherein the coupling of the plug with the socket will compress the peripheral seal against the proximal face.

27. An electrical connector assembly comprising:
a socket comprising:
an open receptacle formed in the socket, defining a cavity that terminates at an immovable wall; and
at least one socket electrical terminal extending through the immovable wall into the receptacle;
a plug comprising:
a body configured for selective retention within the cavity of the receptacle, and having a distal end terminating in an immovable face;
at least one plug electrical terminal carried by the body and accessible through the immovable face, and configured for coupling with the at least one socket electrical terminal; and
a compressible ring-like peripheral seal configured to encircle the immovable face;
wherein coupling of the plug with the socket will urge the peripheral seal against the immovable wall to isolate the at least one socket electrical terminal and the at least one plug electrical terminal from an exterior of the connector assembly.

28. The plug according to claim 27, wherein the peripheral seal comprises a peripheral lip.

29. The plug according to claim 27, wherein the socket and the plug each comprise seven of the electrical terminals.

30. The plug according to claim 27, wherein the peripheral seal is made from a polymeric material.

31. The plug according to claim 30, wherein the polymeric material comprises polyvinyl chloride.

32. The plug according to claim 27, wherein the body is overlain by an outer cover having a differing rigidity.

33. The plug according to claim 27, wherein the peripheral seal is uninterruptedly formed with the body.

34. The plug according to claim 26, wherein the peripheral seal comprises a peripheral lip.

35. The plug according to claim 26, wherein the socket and the plug each comprise seven of the electrical terminals.

36. The plug according to claim 26, wherein the peripheral seal is made from a polymeric material.

37. The plug according to claim 36, wherein the polymeric material comprises polyvinyl chloride.

38. The plug according to claim 26, wherein the body is overlain by an outer cover having a differing rigidity.

39. The plug according to claim 26, wherein the peripheral seal is uninterruptedly formed with the body.

* * * * *

UNITED STATES PATENT AND TRADEMARK OFFICE

CERTIFICATE OF CORRECTION

PATENT NO. : 7,575,450 B2
APPLICATION NO. : 11/277383
DATED : August 18, 2009
INVENTOR(S) : Williams et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 126 days.

Signed and Sealed this

Seventh Day of September, 2010

David J. Kappos

David J. Kappos
*Director of the United States Patent and Trademark Office*